US005613983A

United States Patent [19]

Terry et al.

[11] Patent Number: 5,613,983

[45] Date of Patent: Mar. 25, 1997

[54] METHOD FOR DECOLORIZATION OF FABRICS

[76] Inventors: Raymond Terry, P.O. Box 2, Pickwick Dam, Tenn. 38365; David W. Adcock, P.O. Box 272, Counce, Tenn. 38326

[21] Appl. No.: 384,932

[22] Filed: Feb. 7, 1995

Related U.S. Application Data

[63] Continuation-in-part of Ser. No. 299,054, Aug. 31, 1994, Pat. No. 5,535,469, which is a continuation of Ser. No. 113,612, Aug. 27, 1993, Pat. No. 5,367,734, which is a continuation of Ser. No. 787,554, Nov. 4, 1991, abandoned.

[51] Int. Cl.[6] ..... D06L 3/04

[52] U.S. Cl. ..... 8/102; 8/111; 8/599; 8/625; 8/114; 8/115; 8/149.2; 8/159

[58] Field of Search ..... 8/474, 483, 486, 8/599, 619, 625, 102, 111, 114, 115, 149.2, 149.3, 159, DIG. 14

[56] References Cited

U.S. PATENT DOCUMENTS

| | | | |
|---|---|---|---|
| 4,740,213 | 4/1988 | Ricci | 8/108.1 |
| 5,114,426 | 5/1992 | Milora et al. | 8/102 |
| 5,118,322 | 6/1992 | Wasinger et al. | 8/111 |
| 5,190,562 | 3/1993 | Dickson et al. | 8/111 |
| 5,201,915 | 4/1993 | Ricci | 8/447 |
| 5,261,925 | 11/1993 | Wasinger et al. | 8/111 |
| 5,268,002 | 12/1993 | Olson et al. | 8/107 |
| 5,313,811 | 5/1994 | Wasinger et al. | 68/5 |
| 5,342,415 | 8/1994 | Wasinger et al. | 8/111 |
| 5,531,796 | 7/1996 | Wasinger et al. | 8/102 |

*Primary Examiner*—Margaret Einsmann
*Attorney, Agent, or Firm*—Luedeka, Neely & Graham, P.C.

[57] ABSTRACT

The invention disclosed herein relates to improved methods for decolorizing or fading fabrics with gaseous oxidizing agents. The methods involve tumbling the fabrics in the presence of moisture and a treating agent for delivery of the treating agent to random portions of the fabrics. After tumbling for a sufficient period of time, the fabrics are then oxidized with a gaseous oxidizing agent such as ozone.

22 Claims, 1 Drawing Sheet

METHOD FOR DECOLORIZATION OF FABRICS

This application is a continuation-in-part of application Ser. No. 08/299,054, filed Aug. 31, 1994, now U.S. Pat. No. 5,535,469, which is a continuation of application Ser. No. 08/113,612, filed Aug. 27, 1993, now U.S. Pat. No. 5,367,734, which is a continuation of application Ser. No. 07/787,554, filed Nov. 4, 1991, now abandoned.

FIELD OF THE INVENTION

The present invention relates to methods for selectively fading or decolorizing fabrics. More particularly the present invention relates to improved methods the selective decolorization of fabrics containing an oxidizable dye or coloring agent.

BACKGROUND

The term "fabrics" is used to mean any woven or non-woven material made from natural or synthetic fibers or a combination thereof having a planar structure including smooth or figured cloths such as cotton cloth or cotton blends generally referred to as "denim" or "twill" and any finished textile products made from such materials including trousers, coats, shirts, blouses, skirts, and the like.

Fabrics such as denim or twill having a randomly decolorized or faded effect throughout the entirety of the fabric are very popular. However, to produce the desired effect it has been necessary to utilize processes which sometimes cause substantial deterioration or degradation of the fabric. Bleaching solutions containing chlorine or abrading the garments with sand or stone in the absence of chemical in order to produce the desired fashion effect typically result in damage to the fabrics which ultimately reduces the wear life of garments made from the fabrics.

In an attempt to improve the decolorization or fading of fabrics, an ozone oxidation technique was developed. Ozone has been known to be used for bleaching of cellulosic materials for many years as evidenced by U.S. Pat. No. 2,446,633 to Brabender et al. Likewise, Wasinger et al. U.S. Pat. Nos. 5,118,322; 5,261,925; 5,313,811; and 5,342,415 disclose various methods for ozone treatment of fabrics using blocking agents. According to Wasinger et al. the blocking agents are applied to the fabric in selected areas so that they cover the areas of the fabric to be shielded from ozone attack. However, the known methods for applying blocking agents are quite labor intensive and thus do not readily lend themselves to commercial scale operations.

Accordingly, it is an object of the invention to provide a commercially viable means for randomly decolorizing or fading fabrics.

Another object of the invention is to provide a means for adding a fabric treating agent to a fabric in order to enhance the random oxidation of the fabric.

Still another object of the invention is to provide a delivery system for a treating agent to a fabric for use in the random decolorization of the fabric using an oxidizing agent, whereby damage to the fabric is minimized.

Yet another object of the invention is to provide a less labor intensive method for treating multiple garments in a batch, continuous or semi-continuous operation in order to obtain randomly faded or decolorized fabrics.

Another object of the invention is to produce randomly faded or decolorized fabrics by use of techniques for improved application of treating and oxidizing agents to fabrics.

Other objects and advantages of the invention will be evident from the following disclosure and appended claims.

SUMMARY OF THE INVENTION

With regard to the above and other objects, the present invention provides a method for the random decolorizing or fading of fabric containing oxidizable dyes or coloring agents. The method comprises tumbling the fabric in a chamber in the presence of a fabric treating agent and moisture whereby the treating agent is attached to random portions of the fabric. Next the tumbled fabric containing the treating agent is oxidized with an oxidizing agent whereby portions of the fabric are randomly decolorized or faded.

By effectively tumbling the fabrics for a period of time in the presence of moisture and a treating agent, random portions of the fabric can be selected for decolorizing and/or fading. Furthermore, the methods of the present invention may be adapted to commercially available equipment with little or no added expense and without substantial increase in manpower. In contrast, prior spray, printing, or masking techniques whereby blocking agents rather than the treating agents of this invention are used typically fail to achieve the desired fabric appearance in a manner that can be practiced on a commercial scale.

It has been found that by applying an oxidation inhibitor or oxidation activator that is preferably water soluble, while the fabrics or garments are tumbling, achieves more random application of the agents to substantially all of the fabric being treated. Furthermore, the fashion "look" achieved by the methods of the present invention may be more reproducible with regard to large scale production of such treated fabrics.

While it is preferred that the inhibitor or activator be in powder, pellet, or granular form, it will be recognized that the chamber may also be used to apply liquid solutions of the inhibitor or activator to the fabrics in a random manner as the fabrics are tumbled. Accordingly, an important feature of the invention is the use of a chamber to tumble the fabric or garments during the application of certain fabric or garment treating agents used for achieving the random oxidation of the fabric dyes and/or colorants.

While reference may be made to oxidation of the fabrics by the methods of this invention, it will be recognized that the action of the oxidation agent is on the dye or colorant of the fabric rather than on the fabric fibers themselves. However, as with all oxidizing agents, the fabric fibers may be affected in a minimal way during the oxidation of the dyes or colorants.

SUMMARY OF THE DRAWING

The foregoing advantages and features of the invention may best be understood with reference to the following detailed description and drawing in which.

DETAILED DESCRIPTION OF THE INVENTION

Figure 1:
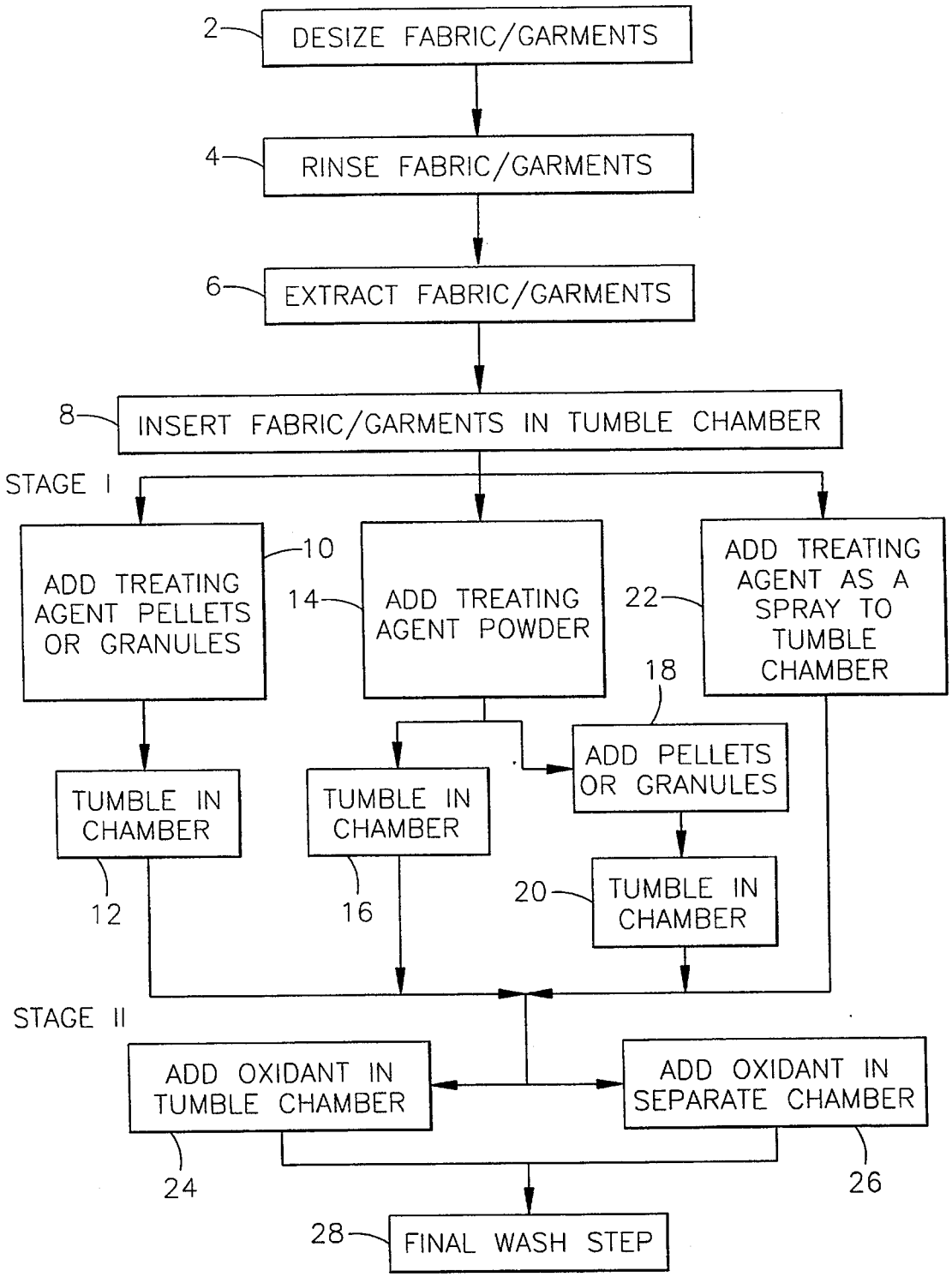
FIG. 1 is a block flow diagram of the various treating schemes for the use of the inhibitors and activators of the invention.

In a preferred embodiment, the present invention relates to methods for randomly decolorizing or fading fabrics, particularly cellulosic fiber containing fabrics having oxidizable dyes or coloring agent applied thereto. Methods for the application of dyes or colorants to fabrics are well known. Likewise, the sizing or desizing of fabrics prior to treatment by the methods of the present invention are well known. Hence, the present invention is particularly directed to treating colored fabrics to obtain a particular fashion "look".

A key feature of the present invention is the use of a chamber for tumbling the fabric during the application of the treating agent. Chambers which may be used include standard commercial washing machines or dryers for tumbling the fabrics in the presence of moisture and the granulated or pelletized treating agent. In the alternative, non-perforated bowl chambers may be used for tumbling the fabrics in the presence of powders and liquids containing the treating agents. In a particularly preferred embodiment, the chamber is adapted to inject steam or water and an oxidizing agent while the fabric is tumbling. In the alternative, steam or water can be injected in a first chamber while tumbling the fabric; the treating agent can be applied to the fabric in a second tumble chamber; and the oxidation agent can be applied to the fabric in a third tumble chamber. In another alternative embodiment, the moisturizing and treating steps of the first and second chambers or the treating and oxidizing steps of the second and third chambers can be combined in a single chamber. Regardless of the number of chambers used, what is important is that the inhibitor or activator be applied to the fabric while the fabrics are tumbling. For the purposes of the present invention, any vessel wherein the fabric and treating agents and/or oxidizing agents can be applied while the fabric is tumbling is suitable and will hereinafter be referred to as a "tumble chamber."

The amount of time the fabric is tumbled is dependent on the amount of treating agent desired to be transferred to the fabric and the strength of the treating agent. Typically, the fabric will be tumbled for a period of time from 10 seconds to 2 hours or more. Tumbling times ranging from about 5 minutes to about 20 minutes are suitable for the application of most treating agents. Regardless of the time the fabric is tumbled, reproducible results may be obtained by tumbling the fabric for essentially the same amount of time with essentially the same amount and strength of treating agent for each batch of fabric thus treated.

If the treating agent is in solid form, it is preferred that the fabric have a moisture content from about 5 to about 50 wt. % prior to or during the treating step. When a liquid treating agent is used, the moisture content of the fabric may be adjusted prior to, during or after the treating step. Subsequent to tumbling the fabric in the presence of the treating agent, the fabric which preferably has the desired moisture content between about 5 and about 50 wt. % is then oxidized with an oxidizing agent whereby the fabric is randomly decolorized or faded. Moisture may be added to the fabric with steam or water sprays during the tumbling step prior to the oxidation step or the fabric may be extracted prior to the tumbling and treating step to the desired moisture content. A combination of initial fabric moisture content and the addition of water to the fabrics by use of steam or water sprays during the tumbling and treating steps may also be used. Likewise, moisture may be added to the fabric during the oxidation step by injecting steam into the chamber along with the oxidizing agent.

The oxidizing agent added during the oxidation step may be a gaseous or liquid oxidizing agent, however, gaseous oxidizing agents are preferred. Gaseous oxidizing agents include chlorine, bromine, $NO_x$, $SO_x$ and ozone gas. From a safety and environmental point of view, ozone gas is the preferred oxidizing agent. Typically, the ozone gas will be admixed with air so that an ozone concentration of about 10 to about 200 grams per cubic meter is obtained.

Contact time of the fabrics with the oxidizing agent are dependant on the oxidant concentration, the reactivity of the dye or colorant with the oxidizing agent and the amount of treating agent on the fabric. Typically, the oxidizing step can be conducted in less than about 3 hours, preferably less than about 2 hour and most preferably from about 10 seconds to about 1 hour or longer.

The oxidizing agent may be applied to the fabric containing the treating agent by spraying the oxidizing agent into the tumble chamber subsequent to contact of the fabric with the treating agent or in a spatially separate chamber. It is preferred, however, that oxidation step also be conducted in a tumble chamber.

During the oxidation step, the oxidizing agent is caused to contact the fabric, preferably while the fabric is tumbling in the chamber. As the fabric tumbles, the oxidant reacts with dyes or colorants in relation to the amount and strength of treating agent on the fabric. Accordingly, when the treating agent is a oxidation activator, the dyes or colorants on the portions of fabric containing the activator are selectively attacked by the oxidant thereby fading the portions of fabric containing the activator much more quickly than the portions of fabric having an absence of the activator. Likewise, when the treating agent is an inhibitor, the portions of the fabric containing the inhibitor may be faded less rapidly than the portions of fabric having an absence of the inhibitor.

Removal of the oxidized dyes or colorants from the fabrics after the oxidation step can be achieved by well known methods such as by washing the oxidized fabrics in hydrogen peroxide solutions and/or detergents.

Both addition of treating agent and the oxidation step may be conducted at any suitable temperature. In general, temperatures in the range of from about 10° to about 90° C. are preferred.

The pressure in the chamber will be dependent on the amount of gaseous oxidizing agent and/or steam added to the chamber. Typically the pressure of the gas within the chamber will be slightly above atmospheric pressure. Accordingly, the chamber should be capable of withstanding gas pressures up to about 20 psia (about 28 kPa) or more.

In the practice of the invention, various oxidation activators or inhibitors may be used as treating agents. The preferred treating agents are water soluble treating agents which are generally known as lake forming compounds. These lake forming compounds are preferred over insoluble oxidation blocking materials because the lake forming compounds typically have a spreading effect on the fabric. Of the inhibitor compounds which may be used, particularly preferred are the metal, alkali or alkaline-earth metal acetates, sulfates, and hydroxides or mixtures thereof. The most preferred inhibitor compounds are selected from the group consisting of aluminum acetate, aluminum sulfate, aluminum hydroxide, magnesium acetate, magnesium hydroxide, sodium bisulfite and mixtures of two or more of the foregoing.

When an oxidation activator is desired to be used, suitable activators may be selected from a carboxylic acid derivative, preferably a derivative of a dicarboxylic acid or anhydride. Of the dicarboxylic acids and anhydrides which may be used as oxidation activators, the most preferred are maleic acid, malic acid, succinic acid, tartaric acid and anhydrides thereof.

The treating agents may applied to the fabrics as powders, pellets or granules. In the alternative, the treating agents may be applied to the fabrics as liquid solutions or by contacting the fabric with a porous adsorbent containing the treating agent in liquid form. Regardless of the method for delivery of the treating agent, typically, the active treating agent in the solid or liquid ranges from about 5 to about 40 wt. % of the solid or liquid.

In order to form a powder containing the treating agent, an amount of treating agent in powder form is admixed with a carrier powder such as sodium bicarbonate to form a essentially dry mixture containing from about 5 to about 40 wt. % treating agent. When sodium bicarbonate is the carrier powder, the treating agent can also be admixed with the sodium bicarbonate by spraying the sodium bicarbonate with a liquid solution containing from about 5 up to about 40 wt. % treating agent.

The carrier may also be a porous material in granular or pellet form such as volcanic pumice. When volcanic pumice is used to deliver the treating agent, the volcanic pumice may be soaked in, dipped in or sprayed with a solution containing from about 5 to about 40 wt.% of the treating agent.

The powdery mixture containing the treating agent may also be pelletized. Pelletizing techniques are well known. For example, a mixture containing from about 56 to about 94 wt. % sodium bicarbonate, from about 5 to about 37 wt. % treating agent and from about 1 to about 6 wt. % sodium silicate may be formed into an erodible pellet using pressure and heat. The term "erodible pellet" means that portions of the exterior surface of the pellet may flake off and/or attach to the fabrics, resulting in a decrease in the size of the pellet during the treating and tumbling operations. A preferred pellet does not substantially crumble or break into smaller pieces while contacting the fabric during the tumbling operation. However, depending on the brittleness of the pellet, some small amount of breakage may occur during the tumbling step.

When the treating agent is in powder form, it is preferred to tumble the fabric in the presence of the powder mixture containing the treating agent and carrier and a resilient granule or pellet to increase the random contact of the powder mixture with the fabric. The granule or pellet may have any desired shape and may be smooth or abrasive. Materials which may be used as granules or pellets include stones, plastic materials, metals and the like.

A particularly preferred abrasive pellet which may be used to enhance contact between the treating agent and the fabric is formed by a mixture comprised of plastic resin, a plasticizer and an abrasive filler and is disclosed in U.S. Pat. No. 5,367,734, incorporated herein by reference as if fully set forth. The components of the abrasive pellet are combined at a temperature sufficient to maintain the mixture in a liquid state. The mixture is then extruded through a die having a cross-sectional shape corresponding to the desired shape of the abrasive member. Once the pellets are cooled, the extrudate may be cut periodically so that pellets of a desired length are obtained. The composition of the abrasive pellet is such that it is hard at room temperature, but becomes pliable at normal wash water temperatures.

A preferred plastic resin for forming the abrasive pellet is GEON 30 (polyvinyl chloride (PVC)) resin manufactured by B. F. Goodrich Co., Chemical Group. The preferred plasticizer is KODAFLEX DOTP plasticizer (bis(2-ethylhexyl) terephthalate) available from Eastman Chemical Products Incorporated, and the preferred abrasive filler is aluminum trihydrate or calcium carbonate. The components of the abrasive pellet are combined such that the mixture contains between about 43 and about 53 wt. % PVC, about 17 to about 27 wt. % plasticizer and about 25 to about 35 wt. % abrasive filler.

The abrasive pellet is made by heating plastic resin to its melting point and then adding a plasticizer and an abrasive filler. The components are mixed at a temperature which is sufficient to maintain the mixture in a liquid state for extrusion. As the mixture is extruded, the temperature of the mixture is maintained in order to form bubbles in the extrudate, which bubbles give the pellet the desired porous consistency upon extrusion. The temperature of the mixture will generally be above about 300° F. (150° C.). Extrusion temperatures are typically maintained between about 310° to 320° F. (154° to 160° C.). At this temperature bubbles will form in the mixture and cause the extruded mixture to be porous. Commercially available single or twin screw extruders from AL-BE Industries, Cincinnati Milacron, Davis Standard, Olympia Tool & Machines, DOMINI, Inc. and Tex America may be used to extrude the mixture to form the pellet.

The porous nature of the pellet insures that as the pellet wears, the abrasive characteristics will remain substantially uniform. For example, instead of becoming smooth as it wears, new porous portions of the pellet are exposed ruing the wearing process which exposes further abrasive surfaces and the exterior of the pellet remains abrasive.

Now with reference to FIG. 1, fabric or garments are first desized then rinsed and extracted according to standard desizing procedures represented by steps 2, 4 and 6 of FIG. 1. In the extraction step 6, a residual moisture content is preferably retained in the fabric or garments. In the alternative, water or steam may be added in subsequent steps of the process in order to increase or maintain the desired moisture content of the fabric or garments.

Stages I and II represent the processes of the present invention. In Stage I, the fabrics or garments are inserted in a tumble chamber 8. At this point, several alternative treatment schemes may be selected. In the first alternative, an erodible treating agent in granular or pellet form is added to the tumble chamber 10, and the fabric or garments are tumbled with the pelletized or granulated treating agent for a period of time sufficient to transfer at least a portion of the treating agent to random portions of the fabric or garments according to step 12.

The second alternative treating scheme for Stage I is represented by steps 14 and 16 or 18 and 20. In step 14, a treating agent in powder form is added to the fabric or garments in the tumble chamber. At this point, the fabric or garments may be tumbled as in step 16 or smooth or abrasive pellets or granules may be added to the tumble chamber prior to tumbling as in steps 18 and 20. Typically, the pellets or granules added to the chamber are resilient and do not erode to the extent of the erodible pellets and granules.

In the third alternative, the treating agent may be sprayed on the fabric or garments while the garments are tumbling in the chamber, step 22. In this step, it is not necessary to include any pellets or granules, however their use is not precluded.

In Stage II of the process, the fabric or garments containing the treating agent are oxidized with an oxidizing agent. The oxidizing agent can be added to the tumble chamber as the fabric or garments are tumbling as in step 22 or the garments can be transferred to a separate chamber for addition of the oxidizing agent as in step 24. The separate chamber may or may not also be a tumble chamber. When the chamber is not a tumble chamber, there must be a suitable means for contacting substantially all portions of the fabrics or garments with the oxidizing agent. Accordingly, the fabrics or garments can be hung on a conveyor that traverses through an oxidation chamber as the oxidizing agent is applied.

Subsequent to the oxidation step, the fabric or garments are then washed to removed any oxidized dyes or coloring agents according to step 26. As noted above, any suitable washing agent may be used such as hydrogen peroxide and/or detergents.

The methods of the present invention which may be applied to large scale production to fade or decolorize garments may be conducted without substantial damage to the fabrics. Treatment times with the inhibitors and activators of the invention are greatly reduced thus decreasing the need to tumble the fabrics for long periods of time with abrasive materials. Furthermore, since the oxidation activators or inhibitors do not agglomerate as readily as do prior oxidation blocking agents, more reproducible results may be obtained by the procedures of the present invention.

While the foregoing sets forth the most preferred embodiments of the present invention, it will be recognized that variations of the invention by those skilled in the art are within the spirit and scope of the appended claims.

What is claimed is:

1. A method for me random decolorizing or fading of fabric containing oxidizable dyes or coloring agents comprising:

tumbling the fabric in a chamber in the presence of a fabric treating agent and moisture whereby the treating agent is attached to random portions of the fabric and is an oxidation inhibitor selected from the group consisting of aluminum acetate aluminum sulfate, aluminum hydroxide, magnesium acetate, magnesium hydroxide and sodium bisulfite or an ozone activator derived from a dicarboxylic acid or anhydride; and oxidizing the fabric containing the treating agent with a gaseous oxidizing agent whereby the oxidized fabric is randomly decolorizcd or faded.

2. The method of claim 1 wherein the oxidizing agent is essentially dry ozone gas.

3. The method of claim 1 further comprising subsequently washing the oxidized fabric in a hydrogen peroxide solution to remove oxidized dyes or colorants therefrom.

4. The method of claim 1 wherein the dicarboxylic acid derivative is tartaric acid.

5. The method of claim 1 wherein the fabric is tumbled with the treating agent in the presence of a resilient pellet or granule.

6. The method of claim 1 wherein the fabric is tumbled in the presence of an erodible granule or pellet containing from about 5 to about 40 wt. % treating agent.

7. The method of claim 1 wherein the treating agent is in powder form and the fabric is tumbled in the presence of the inhibitor powder and a resilient pellet or granular material.

8. A process for randomly fading fabrics comprising:

treating fabrics containing oxidizable dyes or colorants with a desizing agent;

rinsing the fabrics to remove the desizing agent;

extracting the rinse water from the desized fabrics to a moisture content of from about 5 to about 50 wt. %;

tumbling the moist fabric with an erodible pelletized oxidation inhibitor selected from the group consisting of aluminum acetate, aluminum sulfate, aluminum hydrxoxide, magnesium acetate, magnesium hydroxide and sodium bisulfite for a period of time sufficient to transfer an amount of the oxidation inhibitor to the fabric whereby the inhibitor is attached to random portions of the fabric; and oxidizing the fabric with a gaseous oxidizing agent whereby a randomly faded fabric is formed.

9. The process of claim 8 wherein the fabric is tumbled for a period of time from 30 seconds to 2 hours or more.

10. The process of claim 8 wherein the gaseous oxidizing agent is essentially dry ozone gas.

11. The process of claim 8 further comprising subsequently washing the fabric in a hydrogen peroxide solution whereby oxidized dyes or colorants are removed therefrom.

12. A method for decolorizing a cellulosic fiber containing fabric having an oxidizable dye or coloring agent whereby damage to the fibers is substantially avoided, the method comprising:

tumbling the fabric in a chamber with an oxidation inhibitor selected from the group consisting of aluminum acetate, aluminum sulfate, aluminum hydroxide, magnesium acetate, magnesium hydroxide and sodium bisulfite in the presence of moisture for a period of time sufficient to transfer an amount of oxidation inhibitor to random portions of the fabric; and oxidizing the fabric with a gaseous oxidizing agent whereby the oxidized fabric is randomly decolorized.

13. The method of claim 12 wherein the gaseous oxidizing agent is essentially dry ozone gas.

14. The method of claim 12 further comprising subsequently washing the fabric in a hydrogen peroxide solution thereby removing oxidized dyes or coloring agents therefrom.

15. The method of claim 12 wherein the fabric is tumbled with an erodible pellet or granule containing the oxidation inhibitor.

16. The method of claim 12 wherein the oxidation inhibitor is a water soluble powder and the fabric is tumbled in the presence of the powder and a resilient pellet or granule.

17. A method for randomly fading fabric containing an oxidizable dye or coloring agent comprising:

tumbling the fabric in a chamber in the presence of moisture and an oxidation activator derived from a dicarboxylic acid or anhydride; and oxidizing the tumbled fabric in the presence of moisture with a gaseous oxidizing agent whereby a randomly faded fabric is obtained.

18. The method of claim 17 wherein the dicarboxylic acid derivative is tartaric acid.

19. The method of claim 17 wherein the fabric is tumbled in the presence of an erodible granule or pellet containing the oxidation activator.

20. The method of claim 17 wherein the oxidation activator is a essentially dry powder and the fabric is tumbled in the presence of the powder and a resilient pellet or granular material.

21. The method of claim 17 wherein the gaseous oxidizing agent is essentially dry ozone gas.

22. The method of claim 17 wherein the tumbling and oxidizing are conducted in the same chamber.

* * * * *

UNITED STATES PATENT AND TRADEMARK OFFICE

CERTIFICATE OF CORRECTION

PATENT NO. : 5,613,983

DATED : March 25, 1997

INVENTOR(S) : Raymond Terry and David W. Adcock

It is certified that error appears in the above-indentified patent and that said Letters Patent is hereby corrected as shown below:

Column 7, Claim 1, line 29, change "me" to -- the --.

Signed and Sealed this

Seventeenth Day of June, 1997

*Attest:*

Bruce Lehman

BRUCE LEHMAN

*Attesting Officer*

*Commissioner of Patents and Trademarks*